US006446363B1

(12) United States Patent
Artus

(10) Patent No.: US 6,446,363 B1
(45) Date of Patent: Sep. 10, 2002

(54) ALPINE SKI BOOTS HAVING A FLEXIBLE UPPER

(75) Inventor: Jean-Pierre Artus, Le Fontanil (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/195,999

(22) Filed: Nov. 19, 1998

(30) Foreign Application Priority Data

Dec. 5, 1997 (FR) ..... 97 15666

(51) Int. Cl.[7] ..... A43B 5/00
(52) U.S. Cl. ..... 36/117.3; 36/117.2
(58) Field of Search ..... 36/117.3, 119.1, 36/117.1, 102, 117.2, 117.4, 117.5, 115, 31, 32 R

(56) References Cited

U.S. PATENT DOCUMENTS 3,807,062 A * 4/1974 Spier ..... 36/117.2
4,186,500 A * 2/1980 Salzman ..... 36/117.2
4,514,916 A * 5/1985 Aarflot ..... 36/117.2
4,571,858 A * 2/1986 Faulin ..... 36/32 R
4,907,353 A * 3/1990 Wittmann et al. ..... 36/117.2
5,086,575 A * 2/1992 Bonaventure ..... 36/117.3
5,572,806 A 11/1996 Osawa

FOREIGN PATENT DOCUMENTS

EP 0 664 969 A2 8/1995
WO 95 26654 10/1995

* cited by examiner

*Primary Examiner*—M. D. Patterson
(74) *Attorney, Agent, or Firm*—Bugnion S.A.; John Moetteli

(57) ABSTRACT

An alpine ski boot has a flexible upper and a sole permitting the flexing of the foot during walking. The boot comprises essentially a flexible upper (1), an intermediate sole (2) having rigid extremities (7, 8) extending beyond the upper at the front and at the rear and of a form which enables holding by holding elements of a standard ski binding, and a flexible sole (3) preferably of rubber. The intermediate sole is, preferably, made of a semi-rigid plastic, providing a flexible zone or a joint.

18 Claims, 3 Drawing Sheets

ALPINE SKI BOOTS HAVING A FLEXIBLE UPPER

FIELD OF THE INVENTION

The invention relates to an alpine ski boot provided with a sole which permits flexing of the foot during walking.

The first ski boots, being made of leather, were relatively flexible. They offered good comfort and permitted an easy stride, thanks to the flexibility of their sole. In order to assure a good transmission of force between the foot and the ski, that is to say, to reduce the capacity for deformation of the boot, the sole and the upper have become more and more rigid. Consequently, walking has become less and less natural. With the appearance of boots made of plastic materials, the upper, and more particularly the sole has acquired a rigidity assuring an excellent interface between the foot and the ski through the intermediary of a ski binding. This has, however, rendered a normal stride difficult because of the total lack of total flexibility of the sole at the level of the metatarsalphalangeal articulation.

PRIOR ART

For a certain number of years, various means were used in an attempt to facilitate walking when using plastic alpine boots. Patent EP 0 664 969 foresees a flexible zone forming a hinge or junction point in the rigid metatarsalphalangeal zone of the sole and the use of a boot shell having two articulating portions providing the joint, the two parts being, among other things, connected to a locking device which blocks articulation.

A boot constructed according to the same principal is shown in U.S. Pat. No. 5,572,806. This boot differs from the prior boot in that the locking device is slidingly mounted within the confines of the sole. Such boots do not provide a true flexibility which permits a natural operation of the foot during walking. In addition, in that it has an effect on walking, the boots of the prior art are heavy and of little comfort. Another approach to the problem, putting aside stop-gap measures such as the solutions mentioned above, is described in French patent no. 2130644. It consists of a sort of auxiliary housing in which one encloses a boot to the upper and flexible sole.

It is true that boots intended for the practice of cross-country skiing provide a flexibility at the level of the metatarsalphalangeal zone in such a manner which permits an operation of the foot with a minimum of resistance. Such boots are however fixed only at the front end in the manner that it is not necessary that the sole has a longitudinal rigidity as is the case with the soles of ski boots in the conventional ski binding equipped with a toe piece and heel piece.

Today, the persons practicing leisure skiing would like to find a light and comfortable boot on the market permitting at the same time an easy stride and a ski technique with favorable characteristics where the boot is fixed to a ski by means of a conventional binding.

SUMMARY OF THE INVENTION

The invention has the purpose of introducing an alpine ski boot which satisfies this need.

The alpine ski boot according to the present invention is characterized in that it is constituted essentially of an flexible upper; an intermediate sole providing rigid extremities extending beyond the upper at the front and at the rear and further enabling holding elements of a standard ski binding to hold it in the front and the rear; and a flexible sole.

The intermediate sole, preferably of plastic, assures both the flexibility of the sole permitting a natural operation of the foot during walking and the axial rigidity necessary for an alpine ski boot.

According to a first embodiment, the intermediate sole has a flexible intermediate zone.

According to a second embodiment, the intermediate sole is semi-rigid, but has a transverse joint in the metatarsal-phalangeal zone. This joint can be formed by a flexible zone of plastic material of which the intermediate sole is constituted.

According to another embodiment, the intermediate sole is made of two rigid parts and the joint is formed by an axle connected to the two rigid parts. This joint is able to provide a stop limiting the rotation in the opposite direction to the rotation associated with the flexure of the foot. According to one embodiment, the boot is equipped with a means of locking the joint, the locking means possibly being controllable by a lever mounted at the rear of the boot.

It is preferred that the standard rigid zones at the extremities are not covered or overlapped by the flexible sole.

Making a turn necessitates a firm lateral support of the heal in the boot. To this end, the intermediate sole should advantageously provide, in the rear, a reinforcement of the heel surrounding the lower posterior region of the upper.

Certain bindings provide a jaw consisting of two arms which push against the upper. In this case, according to one embodiment, the intermediate sole additionally provides a frontal wall which is substantially vertical, contacting the rounded extremity of the upper and intended to receive the support of a fixation jaw. According to a preferred mode of execution of the invention, the flexible sole laterally straddles the intermediate sole and is connected to the upper on the sides. The attached drawings represent, by way of examples, some embodiments of the invention.

DESCRIPTION OF THE PREFERRED EMBODIMENTS

Figure 2:
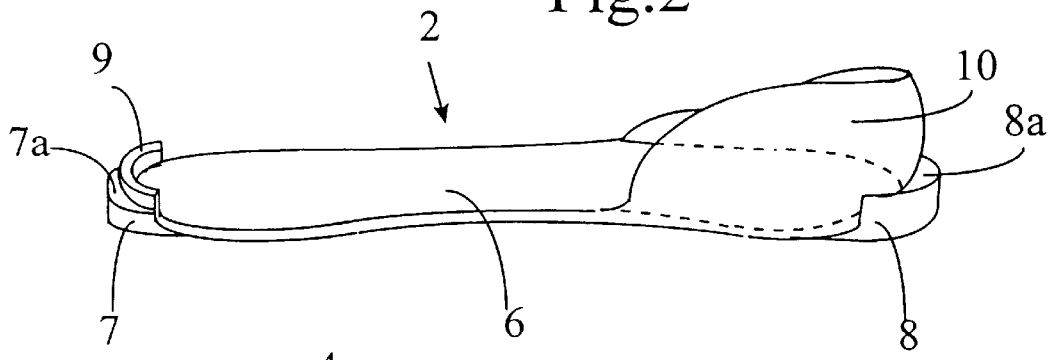
FIG. 2 shows an intermediate sole of the boot seen from above in perspective.
Figure 1:
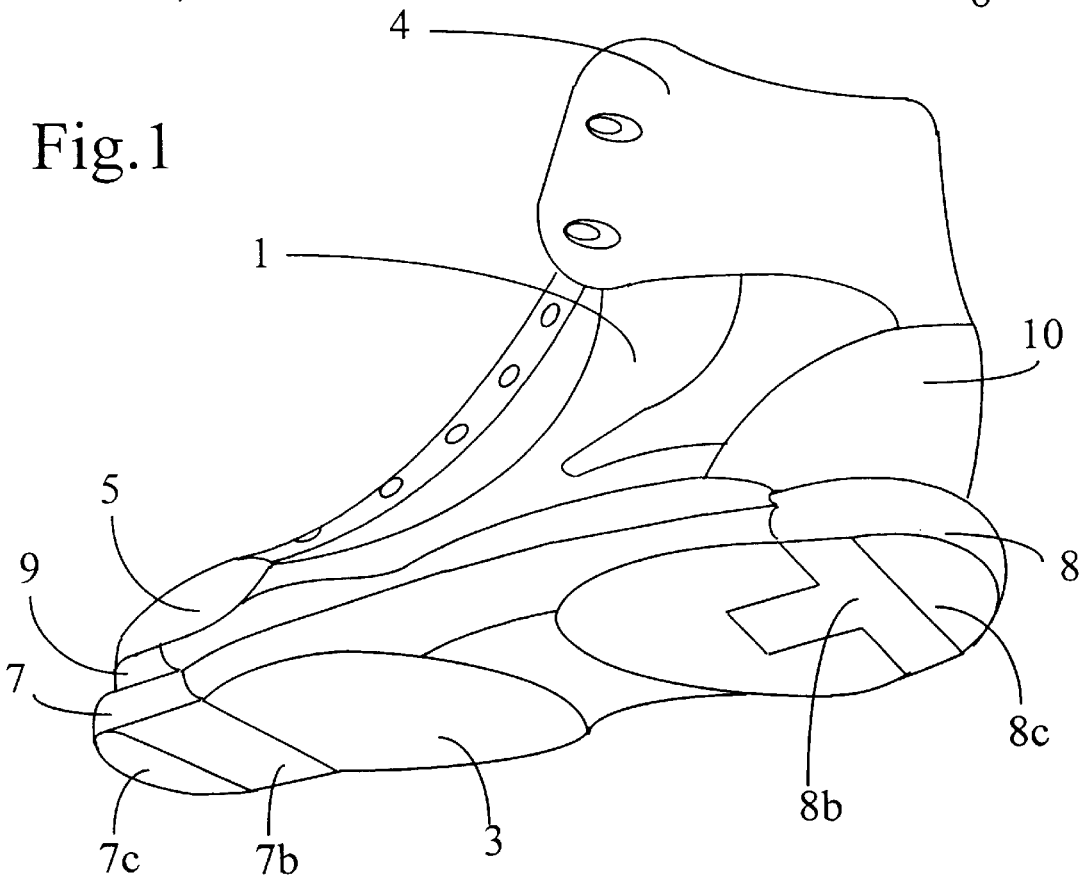
FIG. 1 is a perspective view showing the bottom of a boot according to a first embodiment.

The boot shown in FIG. 1 comprises an flexible upper 1 formed on the front like a traditional hiking boot, glued onto one intermediate sole 2 and a walking sole 3.

The upper 1 provides a means of closing and of tightening (not shown), that may be constituted of a simple lacing or buckles. The upper portion of the upper includes a yoke 4 intended to surround the base of the leg. The front of the upper 1 includes a reinforcing portion 5. The upper 1 is made of leather, of a flexible plastic material, or of fabric, or of a combination of these materials such as one may find in hiking shoes.

The intermediate sole 2 is made of a semi-rigid plastic material. The upper 1 is fixed on the intermediate sole 2 by stitching, by gluing or welding. The intermediate sole 2 comprises an intermediate flexible portion 6 and two substantially more rigid extremities 7 and 8 and protruding surfaces at the bottom of the intermediate portion 6. These more rigid portions 7 and 8 extend beyond the front and rear extremities of the upper and are formed like the front and rear extremities of the ski boot of a traditional plastic material. The portions 7 and 8 comprise therefore a bearing surface 7*a* and 8*a* or a surface on which the front and rear holding elements of the ski binding may bear down upon. The form and the height of the parts 7 and 8 are therefore standard. At the front, on the portion 7, the intermediate sole 2 provides a substantially vertical frontal wall 9 following the shape of the front rounded extremity of the upper 1. In a representative example, this wall 9 is totally integrated into the upper 1. This wall 9 is intended to receive the support of the articulating arms of a front binding jaw. At the rear, the intermediate sole 2 comprises a heel reinforcement 10 surrounding the lower posterior region of the upper 1 and fixed to the upper, in particular, to the portion 4 of the upper. The rigid portion 7 and 8 of the intermediate sole 2 forms a protrusion on the lower face 11 of the intermediate sole. A recessed volume defined by the recessed surface 11 is filled by the walking sole 3, preferably of rubber, such that the surface of the sole comprises a continuity along the sole 3 and the portions 7 and 8. The rubber sole 3 straddles the side of and overlaps the lateral side of the intermediate sole 2 so as to permit connection to the upper. The front part 7 of the intermediate sole 2 shows a planar support surface 7*b* intended to support the boot on an anti-friction pad of the front holding element and a slightly oblique facet 7*c* between the facet 7*b* and the front extremity of the intermediate sole for facilitating walking. In the same way, the rear portion 8 of the intermediate sole provides a support face 8*b* in a "T" shape and an inclined face 8*c* which facilitates walking.

The boot may be able to be provided with a collar at the base of the foot fixed to articulated onto the heal reinforcement 10.

In a variation of the above, the flexible upper 1 may be provided with a internal reinforcement in lieu of external reinforcement 10. During walking, one may be able to observe that the flexing of the sole does not take place except in the metatarsalphalangeal zone. It is not therefore necessary that the intermediate sole be flexible outside of this zone. This is precisely the case in the following embodiment.

Figure 4:
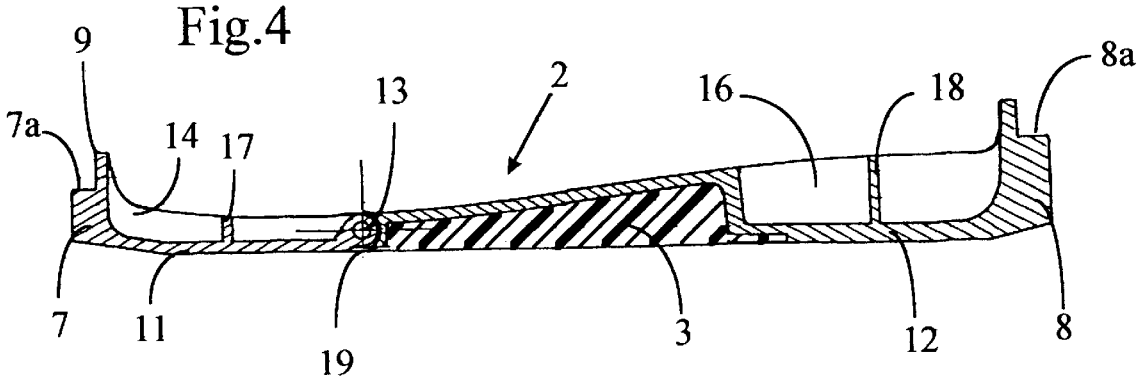
FIG. 4 is a longitudinal cutaway view of an intermediate sole according to a second embodiment.
Figure 5:
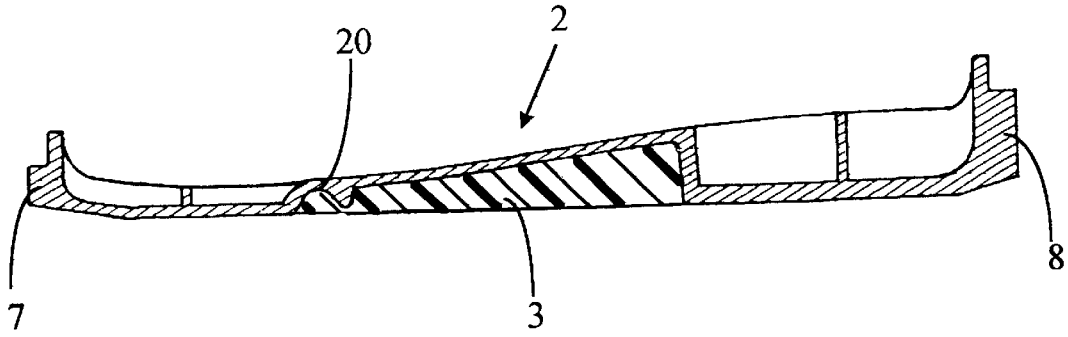
FIG. 5 is a longitudinal cutaway view of an intermediate according to a third embodiment.
Figure 6:
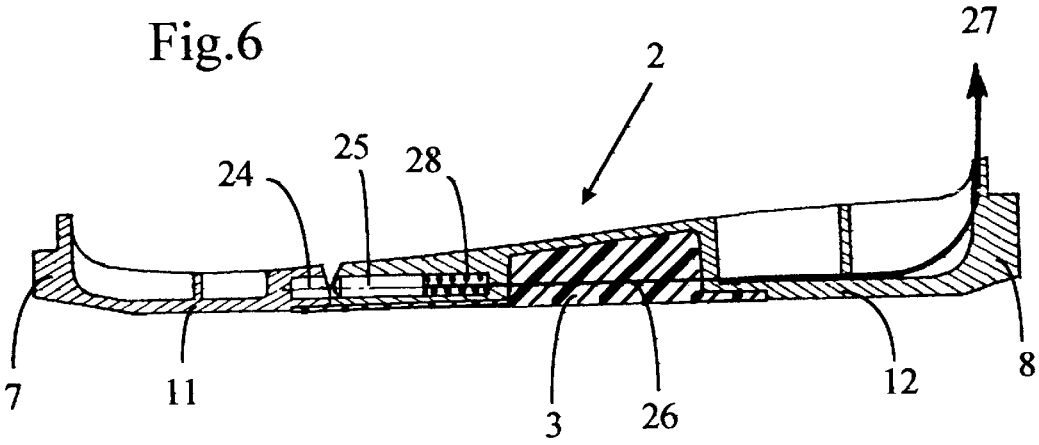
FIG. 6 is a longitudinal cutaway view along VI—VI of FIG. 8, of an embodiment having a lockable joint for the intermediate sole.
Figure 7:
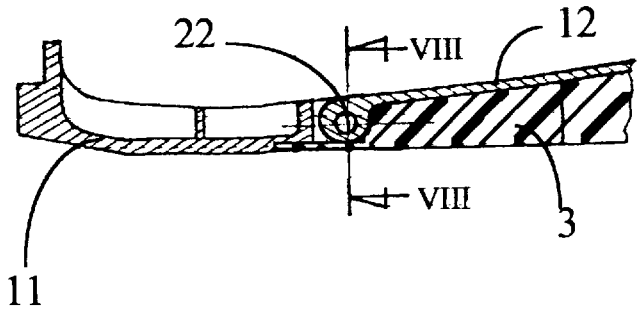
FIG. 7 is a partial view cut according to VII—VII of FIG. 8.
Figure 8:
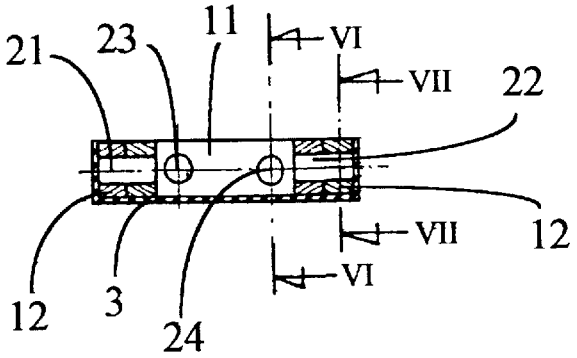
FIG. 8 is a partial cutaway view according to VIII—VIII of FIG. 7.
Figure 9:
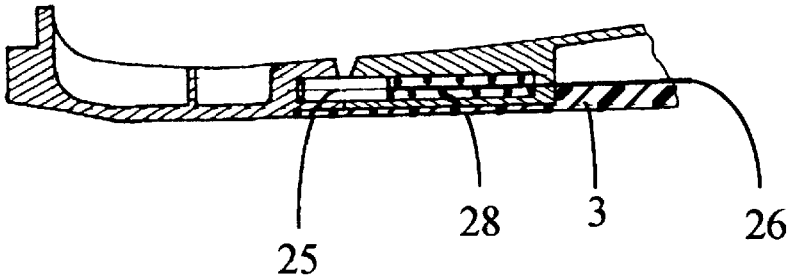
FIG. 9 is a partial view analogous to the view presented in FIG. 6, showing the intermediate sole in a locked position.
Figure 10:
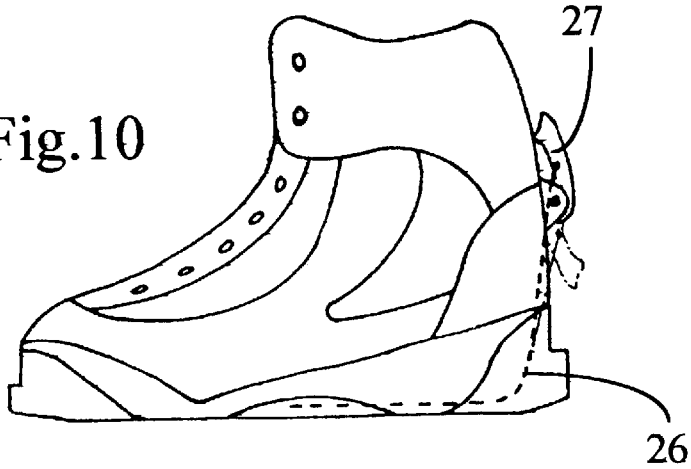
FIG. 10 represents a boot equipped with an intermediate sole according to FIGS. 6–9.

The intermediate sole presented in FIG. 4 is comprised of two rigid parts 11 and 12 of an articulating injection-molded plastic material joined together in the metatarsal zone by means of an axle 13. The portions 11 and 12 are rigidized in the zone which connects with the binding by the longitudinal ribs 14 and 16 and the transverse ribs 17 and 18. The joint 13 shows a stop means 19 preventing the rotation of the two portions of the sole in the opposite direction to the direction of flexing of the foot. One will note again the front and rear portions 7 and 8 and their support surfaces 7*a* and 8*a,* as well as the vertical wall 9 at the front. The rear support face may be in the form of a "T" like the support face 8*b* of the first embodiment. In the embodiment shown in FIG. 5, the intermediate sole is made of a single piece, ribbed like the intermediate sole shown in FIG. 4. The joint of the intermediate sole in the metatarsalphalangeal zone is obtained by the creation of a unribbed zone 20 and is therefore flexible, forming a hinge. In this case, the plastic used must of course provide a flexibility sufficient for the thickness being considered. This flexibility can be obtained for example by a decrease of the thickness, by the utilization of a material which is more flexible in this zone, or by use of an appropriate form permitting the deformation. The embodiment of the intermediate sole according to FIGS. 6 to 9 also has two rigid, articulating portions 11 and 12 interconnected by means of two coaxial axes 21 and 22. Opposite to this joint, the former portion 11 of the intermediate sole shows two recessed longitudinal and parallel holes 23 and 24 in which a pair of rods 25 made of two cylindrical portions engage. The rods are slidably mounted in the location of the lower portion 12 of the intermediate sole. These shafts are attached to a pair of guide cables 26 in the intermediate sole, the extremities of which are attached to an articulating lever 27 at the rear of the boot, as shown in FIG. 10. The rods 25 are biased towards the front by the compression springs 28 in receiving recesses in the intermediate sole. In an upper, retracted position of the lever 27 such as represented by continuous lines in the FIG. 10, the tensile stress exerted on the cables 26 maintains the rods 25 in a retracted position as shown in FIG. 6. In this position, the articulation of the intermediate sole is freed for walking. In a lower position of the lever 27, the stress on the cables 26 is relaxed and the rods 25 are positioned in the recesses 23 and 24 by the springs 28. In this position shown in FIG. 9, the articulation of the intermediate sole is prevented.

Figure 3:
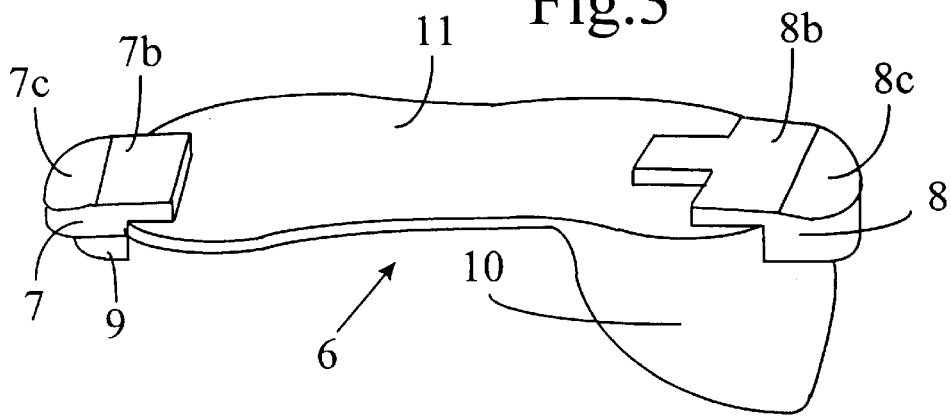
FIG. 3 shows the same intermediate sole in perspective from below, that is to say, rotated 180 degrees around its longitudinal axis relative to the position represented by FIG. 2.

In the embodiments of the joint shown in FIGS. 4 to 10, it can be seen that the rubber sole 3 overlaps the joint in a manner to protect it from scuffing. It can alternatively be applied to the same side of a portion of the support face of the intermediate sole when the support faces have a "T" shape shown in FIG. 8*b* and FIGS. 1 and 3. In general, the rubber sole 3 comes up onto the sides of the boot.

I claim:

1. An alpine ski boot having a front, a rear, a bottom and sides and provided with a sole permitting flexing of a foot of the wearer during walking, characterized in that the boot comprises essentially a flexible upper (1), an intermediate sole (2) comprising a semi-rigid intermediate zone (6) to which are attached rigid extremities (7, 8) extending beyond the upper at the front and rear, against which holding elements of a standard alpine ski binding interface, and a flexible sole (3).

2. The ski boot according to claim 1, characterized in that the intermediate sole (2) has, at the rear, a heal reinforcement (10) surrounding a lower posterior region of the upper.

3. The ski boot according to claim 1, characterized in that the intermediate sole (2) has a frontal, substantially vertical wall (9) intended to receive support from a ski fixation jaw.

4. The ski boot according to claim 1, characterized in that the rigid extremities (7, 8) of the intermediate sole (2) constitute raised surfaces on the intermediate less-rigid zone (6) of the intermediate sole and that the flexible upper (3) extends between the rigid extremities (7, 8) adjacent the intermediate sole.

5. The ski boot according to claim, 1 characterized in that the bottom of the boot is continuous along the rigid extremities (7, 8) of the intermediate sole and the flexible sole.

6. The ski boot according to claim 4, characterized in that the rigid extremities (7, 8) of the intermediate sole have lower support faces (7*b*, 8*b*) intended to interface with portions of the ski binding.

7. The ski boot according to claim 6, characterized in that the rigid extremities (7, 8) of the intermediate sole have inclined faces (7*c*, 8*c*) between the lower support faces (7*b*, 8*b*) and each of the extremities of the intermediate sole.

8. The ski boot according to claim 1, characterized in that the flexible sole (3) laterally straddles the intermediate sole (2) and is connected to the upper on the sides.

9. The ski boot according to claim 2, characterized in that the boot includes a yoke (4) fixed to the heal reinforcement (10).

10. The ski boot according claim 1, characterized in that the rigid extremities (7, 8) are not covered by the flexible sole (1).

11. The ski boot according to claim 1, characterized in that the flexible upper (1) is glued onto the intermediate sole (2).

12. The ski boot according to claim 1, characterized in that the intermediate sole is rigid and includes a transverse joint (13, 20, 21, 22) in the metatarsal zone.

13. The ski boot according to claim 12, characterized in that the intermediate sole is made of a plastic material and the joint is formed by a flexible zone (20) of a plastic material.

14. The ski boot according to claim 12, characterized in that the intermediate sole is made of two rigid portions (11, 12) and that the joint consists of an axle (13, 21, 22) connected to the two rigid portions.

15. The ski boot according to claim 14, characterized in that the joint has a stop (19) limiting the rotation in the opposite direction to the rotation associated with the flexing of the foot.

16. The ski boot according to claim 14, characterized in that it comprises a locking means (25) for the joint.

17. The ski boot according to claim 14 characterized in that the locking means is controllable by a lever (27) mounted at the rear of the boot.

18. The ski boot according to claim 17, characterized in that the locking means include a longitudinal rod (25) and a heal reinforcement (10) surrounding the lower posterior region of the upper.

* * * * *